US010526150B2

(12) United States Patent
Miyajima et al.

(10) Patent No.: US 10,526,150 B2
(45) Date of Patent: Jan. 7, 2020

(54) DRIVE APPARATUS AND IMAGE FORMING APPARATUS

(71) Applicant: KONICA MINOLTA, INC., Tokyo (JP)

(72) Inventors: Satoshi Miyajima, Hino (JP); Hiroshi Oyama, Hino (JP); Remi Ishikawa, Mitaka (JP); Tadayuki Ueda, Kokubunji (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 16/182,888

(22) Filed: Nov. 7, 2018

(65) Prior Publication Data

US 2019/0152733 A1 May 23, 2019

(30) Foreign Application Priority Data

Nov. 17, 2017 (JP) ..... 2017-221585

(51) Int. Cl.
*B65H 7/00* (2006.01)
*B65H 5/06* (2006.01)

(52) U.S. Cl.
CPC ..... *B65H 7/00* (2013.01); *B65H 5/06* (2013.01)

(58) Field of Classification Search
CPC ..... B65H 5/06; B65H 7/00; B65H 29/125; B65H 29/12; B65H 2403/50; B65H 2403/944; B65H 2403/94; B65H 2515/30; B65H 2555/25; B65H 2555/252; B65H 2555/26; B65H 2557/10; B65H 2557/63
See application file for complete search history.

(56) References Cited

U.S. PATENT DOCUMENTS

2018/0334342 A1* 11/2018 Miyajima ..... B65H 7/00

FOREIGN PATENT DOCUMENTS

JP 2006-017988 A 1/2006

* cited by examiner

*Primary Examiner* — David H Bollinger
(74) *Attorney, Agent, or Firm* — Buchanan Ingersoll & Rooney PC

(57) ABSTRACT

A drive apparatus according to the present invention includes a first motor that transmits power to a rotating shaft of a conveyance roller for conveying a sheet, a second motor that transmits power to the rotating shaft of the conveyance roller, a storage that stores information indicating the driving force of the second motor during a period in which the conveyance roller conveys the sheet; and a controller that drives the second motor with the driving force indicated by the information during a period when the conveyance roller conveys the sheet, wherein the controller changes the information stored in the storage according to a load applied to the conveyance roller during the period when the conveyance roller conveys the sheet, and drives the second motor with a driving force indicated by the information after the change during a period when the conveyance roller conveys a next sheet.

14 Claims, 10 Drawing Sheets

FIG.6

300

| 310 Event number | 320 Data number | 330 Setting duty [%] | 340 STM current [mA] |
|---|---|---|---|
| 0 | 0 | 15 | 2000 |
| | 1 | 15 | 2000 |
| | 2 | 15 | 2000 |
| | 3 | 15 | 2000 |
| | 4 | 15 | 2000 |
| | 5 | 15 | 2000 |
| | 6 | 15 | 2000 |
| | 7 | 15 | 2000 |
| | 8 | 20 | 3000 |
| | 9 | 25 | 3000 |
| 1 | 0 | 30 | 3000 |
| | 1 | 35 | 3000 |
| | 2 | 40 | 3000 |
| | 3 | 50 | 3000 |
| | 4 | 50 | 3000 |
| | 5 | 40 | 3000 |
| | 6 | 40 | 3000 |
| | 7 | 40 | 3000 |
| | 8 | 40 | 3000 |
| | 9 | 40 | 3000 |
| 2 | 0 | 35 | 3000 |
| | 1 | 35 | 3000 |
| | 2 | 30 | 3000 |
| | 3 | 30 | 3000 |
| | 4 | 30 | 3000 |
| | 5 | 30 | 3000 |
| | 6 | 20 | 3000 |
| | 7 | 20 | 3000 |
| | 8 | 15 | 2000 |
| | 9 | 15 | 2000 |
| | 10 | 15 | 2000 |

FIG.7

400

| Reference current value difference [mA] | Setting duty [%] |
|---|---|
| -300 | -30 |
| -200 | -20 |
| -100 | -10 |
| -50 | -5 |
| ±0 | 0 |
| +50 | +5 |
| +100 | +10 |
| +200 | +20 |
| +300 | +30 |

FIG.8( a ) Photosensor
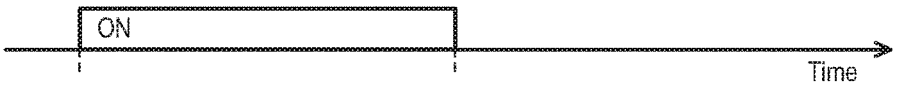
FIG.8( b ) Photosensor
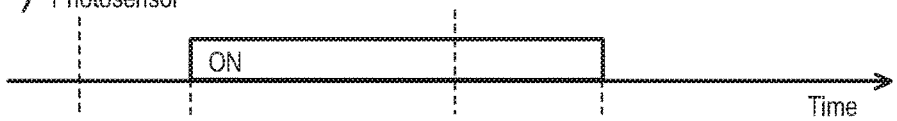
FIG.8( c ) Photosensor
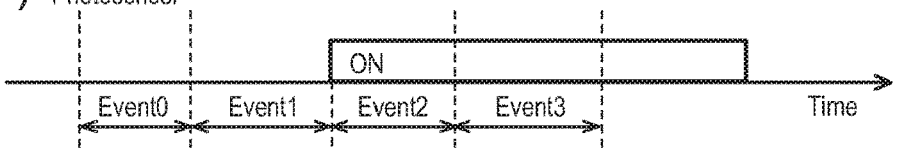
FIG.8( d ) Reference current value
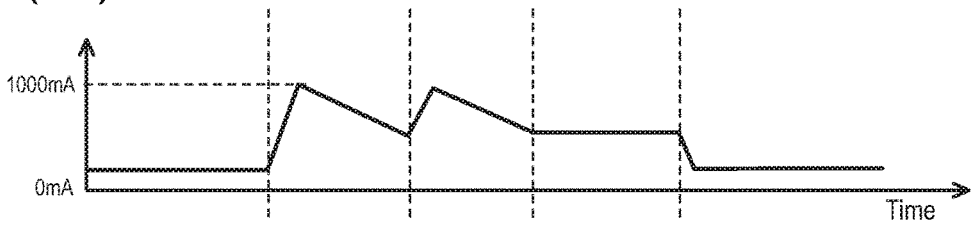
FIG.8( e ) Reference duty command value
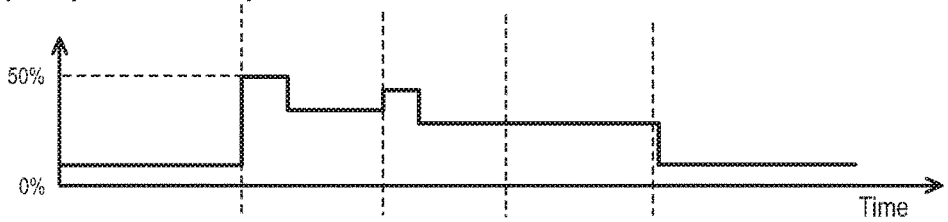
FIG.8( f ) Effective current value
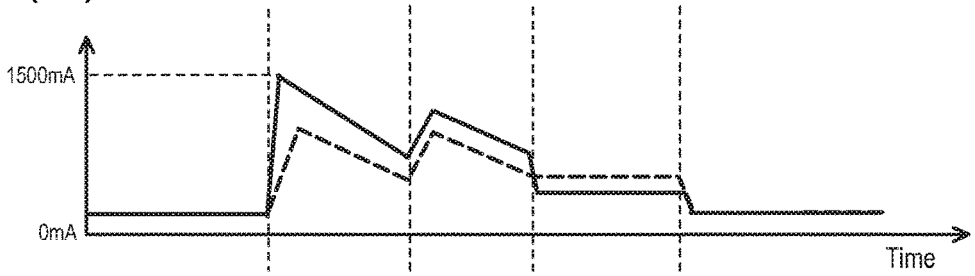
FIG.8( g ) Duty command value of next sheet
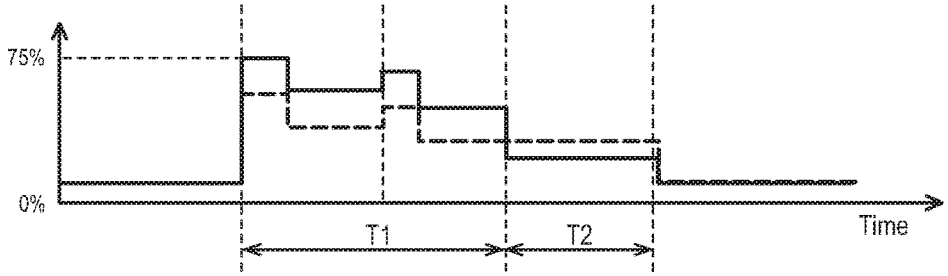

FIG.9 ( a )
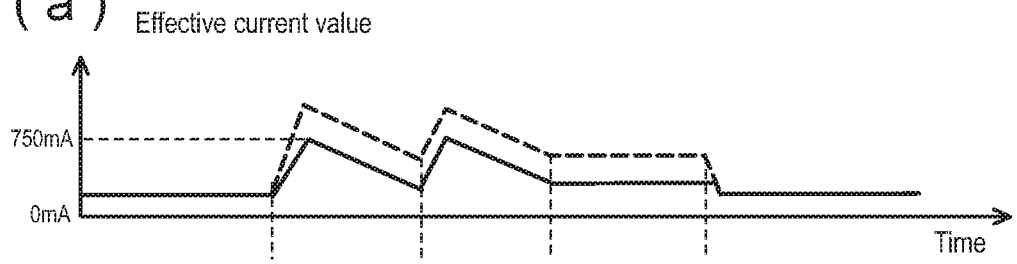
FIG.9 ( b )
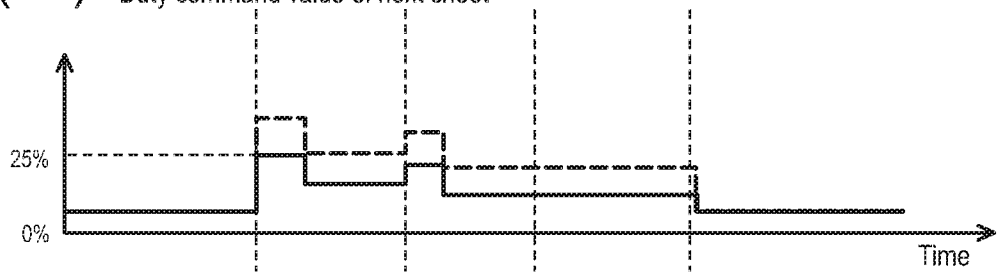
FIG.9 ( c )
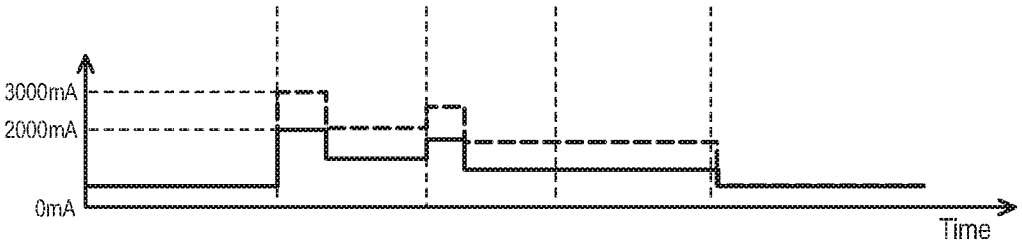

DRIVE APPARATUS AND IMAGE FORMING APPARATUS

CROSS-REFERENCE TO RELATED APPLICATION

Japanese patent application No. 2017-221585 filed on Nov. 17, 2017, including description, claims, drawings, and abstract the entire disclosure is incorporated herein by reference in its entirety.

BACKGROUND

1. Technological Field

The present invention relates to a drive apparatus and an image forming apparatus.

2. Description of the Related Art

In an image forming apparatus such as an electrophotographic printer, a conveyance roller for conveying a sheet is driven by a single motor such as a stepping motor or a DC (direct current) brushless motor.

On the other hand, in recent years, a technique for driving a conveyance roller by two motors has been developed. For example, Unexamined Japanese Patent Publication No. 2006-017988 discloses a technique for supplementally transmitting a power of a DC brushless motor to a rotating shaft driven by a stepping motor. A technique for driving the rotating shaft with two DC brushless motors is also known.

SUMMARY

When a sheet is conveyed along a conveying path inside the image forming apparatus, in some cases, one sheet is held at the same time by two or more pairs of conveyance rollers adjacent to each other along the conveying direction. For example, when one sheet is held by two pairs of conveyance rollers at the same time, the two pairs of conveyance rollers are driven at the same rotation speed so as to convey the sheet at the same conveyance speed.

However, even if the two pairs of conveyance rollers are driven at the same rotation speed, in some cases, a difference in the sheet conveyance speed of the two pairs of conveyance rollers occurs due to the change with time of the conveyance roller and the mechanical tolerance. In the case where there is a difference in sheet conveyance speed between the two pairs of conveyance rollers, when the two pairs of conveyance rollers hold one sheet simultaneously, the force is transmitted through the sheet, and the driving load of the conveyance roller may change. For example, when the sheet conveyance speed of the conveyance roller disposed downstream of the conveying path is higher than the sheet conveyance speed of the conveyance roller disposed on the upstream, the upstream conveyance roller is pulled by the downstream conveyance roller via the sheet, and the driving load of the upstream conveyance roller decreases. Conversely, in a case where the sheet conveyance speed of the conveyance roller disposed downstream of the conveying path is slower than the sheet conveyance speed of the conveyance roller disposed upstream, when the sheet to be conveyed is thick, the upstream conveyance roller pushes the downstream conveyance roller via the sheet, whereby the driving load of the upstream conveyance roller increases.

In the case where the conveyance roller is driven by the two motors of the stepping motor and the DC brushless motor, when the driving load of the conveyance roller is light, the stepping motor may step out. Further, when the conveyance roller is driven by the two DC brushless motors, when the driving load of the conveyance roller is heavy, a delay in sheet transportation may occur.

The present invention has been made in view of the above-described problems. It is therefore an object of the present invention to provide a drive apparatus and an image forming apparatus capable of implementing a stable operation against fluctuation of a load with respect to a driving mechanism for driving a rotating shaft of the conveyance roller by two motors.

To achieve at least one of the abovementioned objects, according to an aspect of the present invention, the drive apparatus reflecting one aspect of the present invention comprises: a first motor that transmits a power to a rotating shaft of a conveyance roller for conveying a sheet; a second motor that transmits a power to said rotating shaft of said conveyance roller; a storage that stores information indicating a driving force of said second motor during a period in which said conveyance roller conveys said sheet; and a controller that drives said second motor with said driving force indicated by said information during a period when said conveyance roller conveys said sheet, wherein said controller changes said information stored in said storage according to a load applied to said conveyance roller during said period when said conveyance roller conveys said sheet, and drives said second motor with a driving force indicated by said changed information after said change during a period when said conveyance roller conveys a next sheet.

The objects, features, and characteristics of this invention other than those set forth above will become apparent from the description given herein below with reference to preferred embodiments illustrated in the accompanying drawings.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

FIG. 6 is a diagram showing an example of a control table;

FIG. 7 is a diagram showing an example of a correction table;

FIGS. 8(*a*)-8(*g*) are diagrams for explaining the sheet conveyance process;

FIGS. 9(*a*)-9(*c*) are diagrams for explaining a sheet conveyance process according to a modification.

DETAILED DESCRIPTION OF EMBODIMENTS

Figure 1:
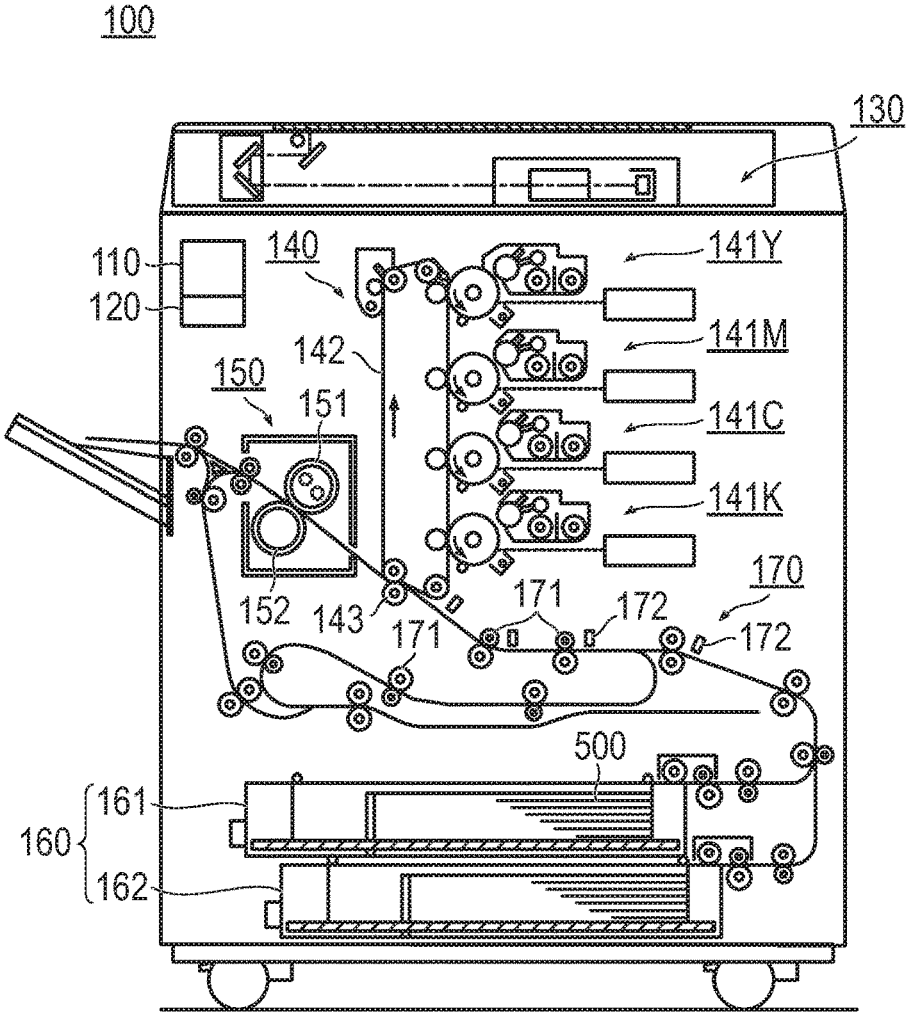
FIG. 1 is a cross-sectional view showing a schematic configuration of an image forming apparatus according to a first embodiment of the present invention.

Hereinafter, one or more embodiments of the present invention will be described with reference to the drawings. However, the scope of the invention is not limited to the disclosed embodiments.

Hereinafter, embodiments of the present invention will be described in detail with reference to the drawings. In the description of the drawings, the same elements are denoted by the same reference numerals, and duplicate descriptions are omitted. Also, the dimensional ratios of the drawings are exaggerated for convenience of explanation and may differ from the actual ratio.

First Embodiment

FIG. 1 is a cross-sectional view showing a schematic configuration of an image forming apparatus 100 according to a first embodiment of the present invention. As shown in FIG. 1, the image forming apparatus 100 of the present embodiment includes a controller 110, a storage 120, an image reader 130, an image former 140, a fixing unit 150, a sheet feeder 160, and a sheet conveyor 170.

The controller 110 is a CPU (Central Processing Unit), and performs control of each of the above units and various arithmetic processing according to a program.

The storage 120 includes a ROM (Read Only Memory) in which various programs and various data are stored in advance, a RAM (Random Access Memory) for temporarily storing programs and data as a work area, a hard disk for storing various programs and various data, and the like. A control table used for controlling two motors driving a conveyance roller for conveying a sheet 500 and a correction table used for changing output torque of a DC brushless motor are stored in the storage 120. A plurality of control tables are stored for each type of sheets 500.

The image reader 130 includes a light source such as a fluorescent lamp and an imaging device such as a CCD (Charge Coupled Device) image sensor. The image reader 130 applies light from a light source to a document set at a predetermined reading position, photoelectrically converts the reflected light by the imaging device, and generates image data from the electrical signal.

The image former 140 includes image forming units 141Y to 141K corresponding to toners of respective colors of Y (yellow), M (magenta), C (cyan), and K (black). The toner image formed by the processes of charging, exposing, and developing by the image forming units 141Y to 141K are successively superimposed on an intermediate transfer belt 142 and transferred onto the sheet 500 by a secondary transfer roller 143.

The fixing unit 150 includes a heating roller 151 and a pressure roller 152. The fixing unit 150 heats and pressurizes the sheet 500 conveyed to a fixing nip between the both rollers 151 and 152 to fuse-fix the toner image on the sheet 500 to its surface.

The sheet feeder 160 includes a plurality of sheet feeding trays 161 and 162, and feeds the sheets 500 accommodated in the sheet feeding trays 161 and 162 one by one to a downstream conveying path.

The sheet conveyor 170 includes a plurality of conveyance rollers 171 for conveying the sheet 500, and conveys the sheet 500 between the image former 140, the fixing unit 150, and the sheet feeder 160. In the image forming apparatus 100 of the present embodiment, one or more of the plurality of conveyance rollers 171 are driven by a drive apparatus 200 (see FIG. 2) having two motors. A photosensor 172 for detecting the presence or absence of the sheet 500 is provided on the upstream side of each conveyance roller 171 in the sheet conveying direction.

Next, with reference to FIG. 2 and FIG. 3, the drive apparatus 200 for driving the conveyance rollers 171 by the two motors will be described in detail.

Figure 2:
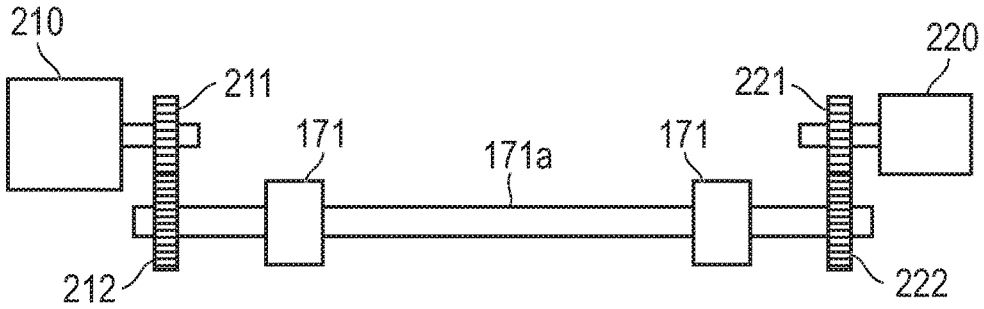
FIG. 2 is a plan view showing a schematic configuration of a drive apparatus.
Figure 3:
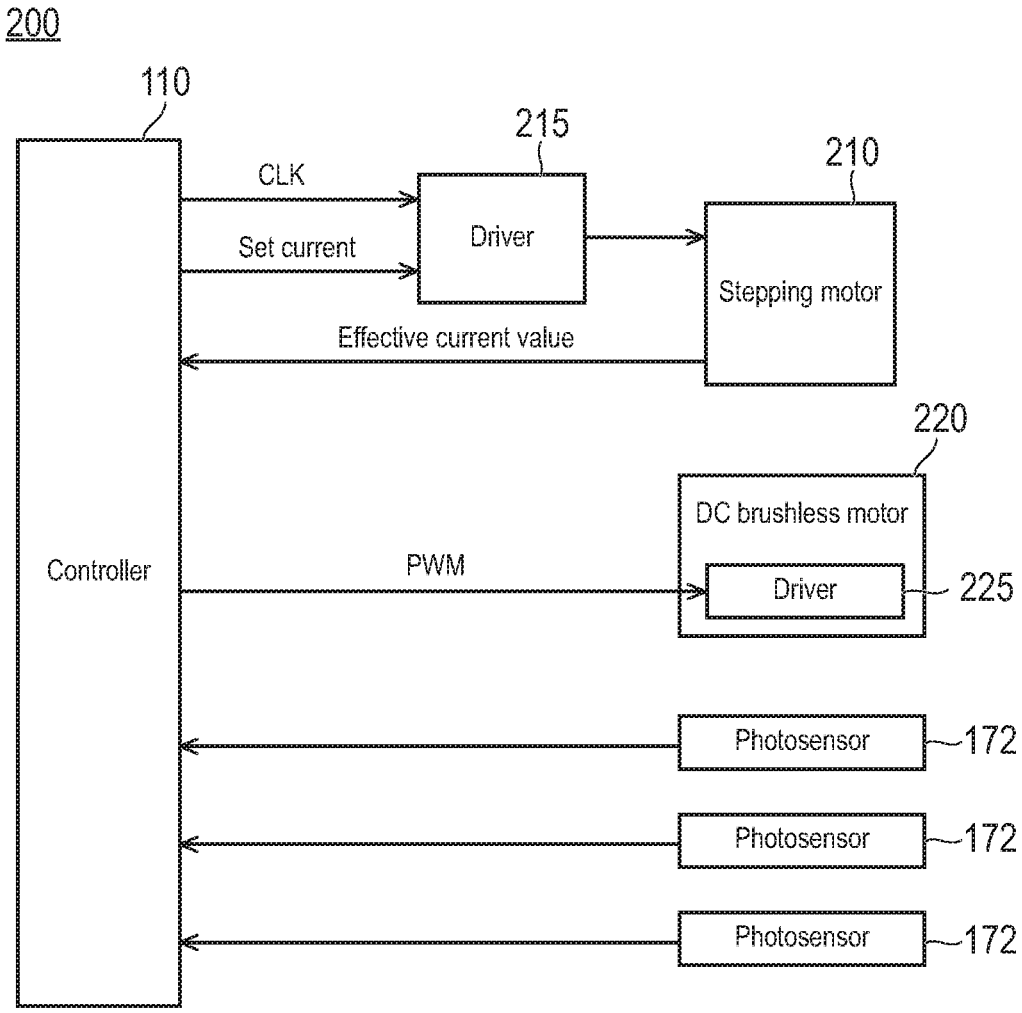
FIG. 3 is a block diagram showing a control system of the drive apparatus.

FIG. 2 is a plan view showing a schematic configuration of the drive apparatus 200, and FIG. 3 is a block diagram showing a control system of the drive apparatus 200.

As shown in FIG. 2, the drive apparatus 200 includes a stepping motor 210 and a DC brushless motor 220. The stepping motor 210 is coupled via a plurality of gears 211 and 212 to a rotating shaft 171*a* of the conveyance roller 171 so as to transmit the power. Further, the DC brushless motor 220 is coupled via a plurality of gears 221 and 222 to the rotating shaft 171*a* of the conveyance roller 171 so as to transmit the power. Output torque of the stepping motor 210 is larger than output torque of the DC brushless motor 220, and rotation speed of the conveyance roller 171 is controlled by rotation speed of the stepping motor 210.

As shown in FIG. 3, the controller 110 of the image forming apparatus 100 controls the operations of the stepping motor 210 and the DC brushless motor 220.

The controller 110 controls the rotation speed of the stepping motor 210 by transmitting a clock signal (CLK) to a driver 215 for the stepping motor 210, and setting the operating frequency of the stepping motor 210. In addition, the controller 110 transmits a set current signal to the driver 215 to set the current value of the stepping motor 210, thereby controlling the torque generated in the stepping motor 210. Further, the controller 110 is electrically connected to the stepping motor 210, and detects a current value (hereinafter also referred to as "effective current value") of a current actually supplied from the driver 215 to the stepping motor 210. In the case where the stepping motor 210 rotates at a high speed, even when the stepping motor 210 is subjected to constant current control, the stepping motor 210 shows the behavior by constant voltage control, and the effective current value changes according to the load acting on the stepping motor 210.

The controller 110 transmits a PWM (Pulse Width Modulation) signal to a built-in driver 225 of the DC brushless motor 220 to set a control value (duty command value) of the DC brushless motor 220, thereby controlling the torque generated in the DC brushless motor 220.

Further, the controller 110 is electrically connected to the plurality of photosensors 172 disposed on the conveying path of the sheet 500, and acquires output signals of the photosensors 172.

Note that the image forming apparatus 100 may include constituent elements other than the above-described constituent elements, or may not include part of the above-described constituent elements.

In the image forming apparatus 100 configured as described above, when the conveyance rollers 171 driven by the two motors 210 and 220 conveys the sheet 500, the load applied to the conveyance roller 171 is detected, and the driving force of the DC brushless motor 220 is changed when the next sheet 500 is conveyed. Hereinafter, with reference to FIGS. 4 to 8, the operation of the image forming apparatus 100 according to the present embodiment will be described in detail.

Figure 4:
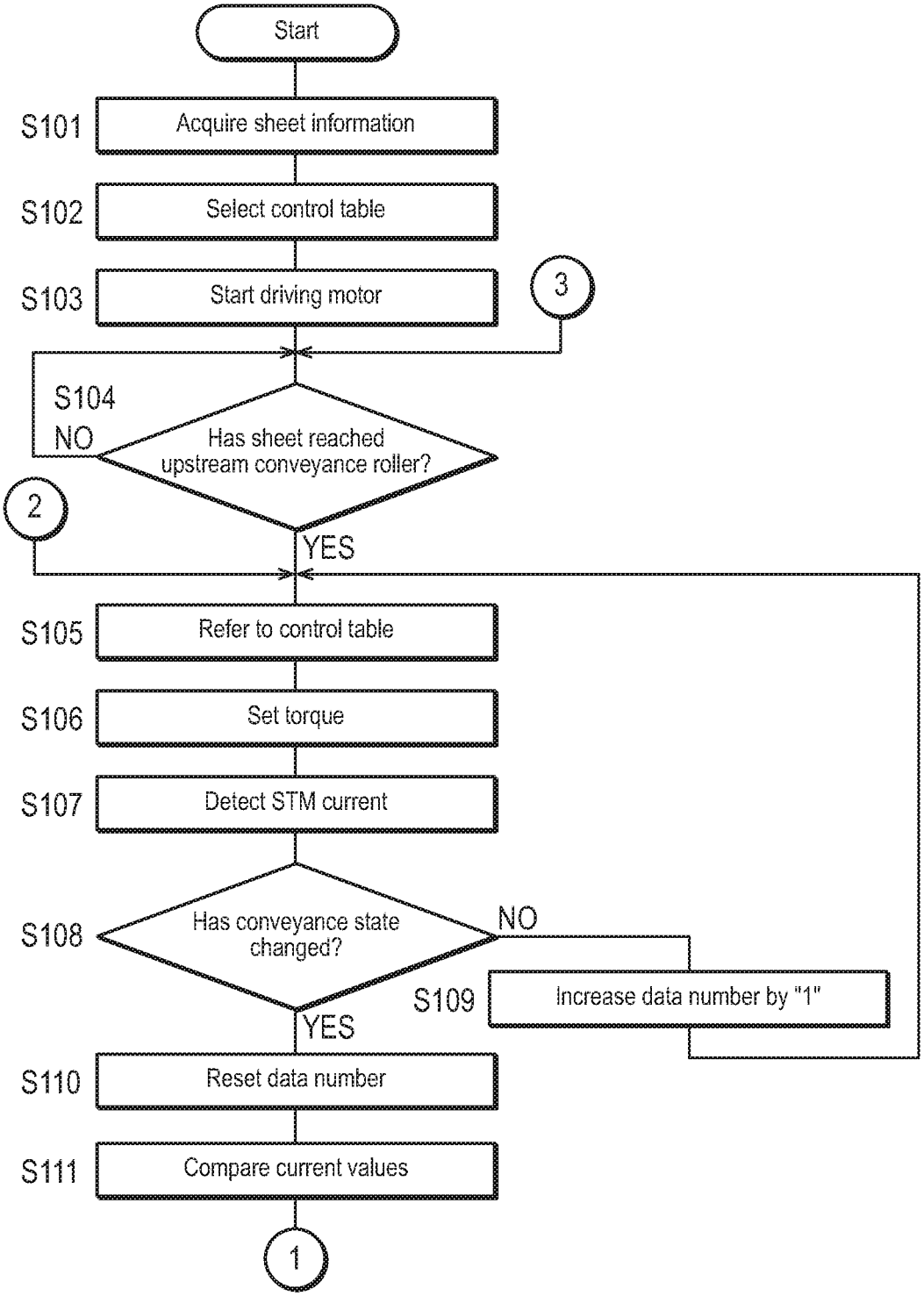
FIG. 4 is a flowchart showing a procedure of a sheet conveyance process.
Figure 5:
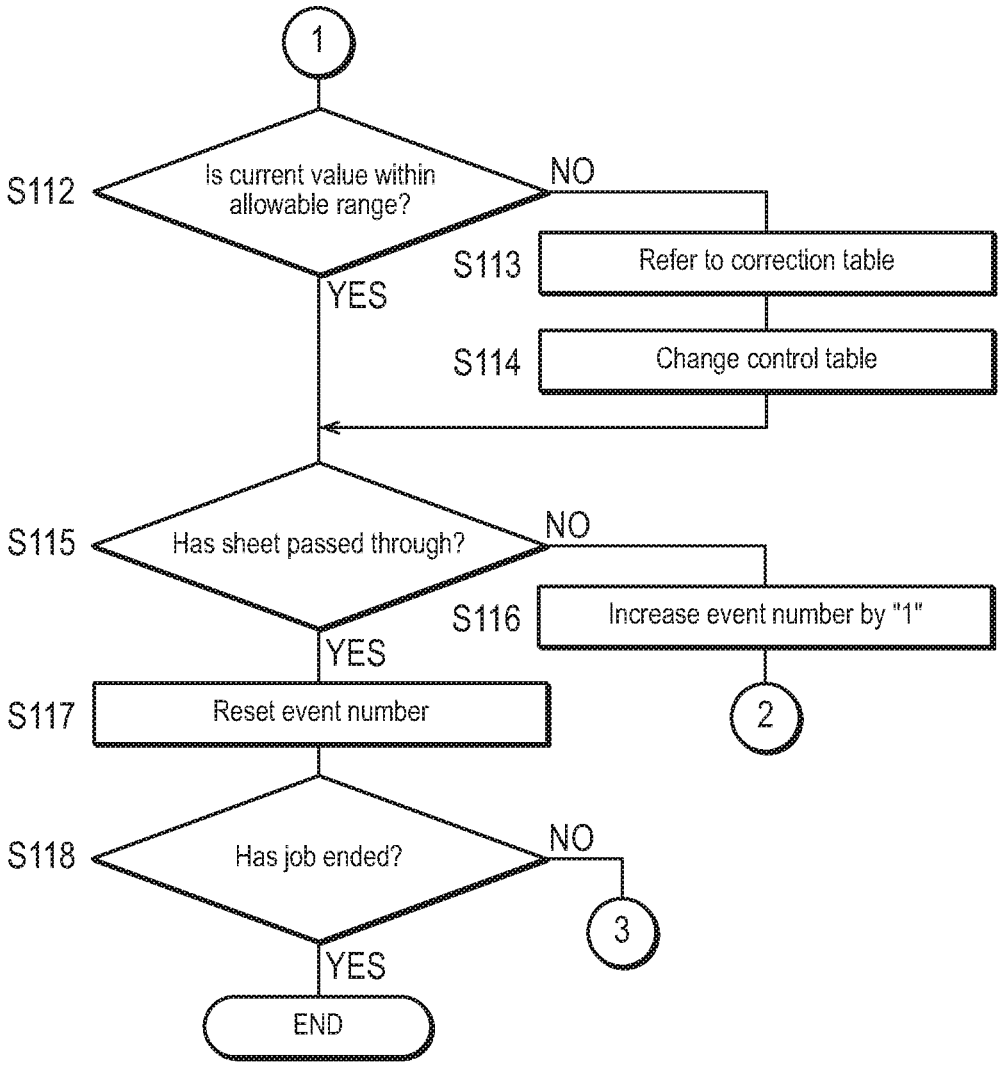
FIG. 5 is a flowchart following FIG. 4.

FIGS. 4 and 5 are a flowchart showing a procedure of a sheet conveyance process performed by the image forming apparatus 100. The algorithm shown by the flowchart in FIGS. 4 and 5 is stored as a program in the storage 120, and is executed by the controller 110. In the following description, a case will be exemplified in which the image forming apparatus 100 performs a print job that continuously forms images on a plurality of sheets 500 under the same conditions.

First, the controller 110 acquires information on the sheet used for printing, and recognizes the type of the sheet 500 (step S101).

Next, the controller 110 selects one control table 300 (see FIG. 6) corresponding to the type of sheet from a plurality of control tables stored in the storage 120 for each sheet type (step S102).

FIG. 6 is a diagram showing an example of the control table. The control table 300 includes event number information 310, data number information 320, duty command value information 330, and set current value information 340.

The event number information 310 is identification information of each event when dividing the periods for which the conveyance roller 171 conveys the sheet 500 into a plurality of events. The event number is "0" at the time when the sheet 500 reaches another conveyance roller 171 adjacent to the conveyance roller 171 to be controlled on the upstream side, and increases by "1" when the conveyance state of the sheet changes.

The data number information 320 is identification information of each unit period when each event is divided into a plurality of unit periods. The data number is "0" at the time when the corresponding event occurs and increases by "1" when the unit period has elapsed. The plurality of unit periods has the same length, and the number of data numbers in each event corresponds to a value obtained by dividing the time required for conveying a sheet between adjacent conveyance rollers by the unit period.

The duty command value information 330 is information indicating the duty command value of the DC brushless motor 220 in the unit period specified by the event number information 310 and the data number information 320. The set current value information 340 is information indicating the set current value of the stepping motor 210 in the unit period specified by the event number information 310 and the data number information 320.

In the process shown in step S102, when the control table 300 corresponding to the type of sheet is selected, the controller 110 starts to drive the two motors 210 and 220 (step S103). More specifically, the controller 110 activates the stepping motor 210 and the DC brushless motor 220 so that the stepping motor 210 and the DC brushless motor 220 rotate at a predetermined rotation speed.

Next, the controller 110 determines whether the sheet 500 has reached another conveyance roller 171 adjacent to the conveyance roller 171 to be controlled on the upstream side (step S104). More specifically, the controller 110 determines whether the photosensor 172 in the vicinity of another conveyance roller 171 adjacent to the conveyance roller 171 to be controlled on the upstream side has changed from the OFF state to the ON state.

When determining that the sheet 500 has not reached another conveyance roller 171 adjacent to the conveyance roller 171 to be controlled on the upstream side (step S104: NO), the controller 110 waits until the sheet 500 reaches another conveyance roller 171 adjacent to the conveyance roller 171 to be controlled on the upstream side.

On the other hand, when determining that the sheet 500 has reached another conveyance roller 171 adjacent to the conveyance roller 171 to be controlled on the upstream side (step S104: YES), the controller 110 refers to the control table 300 (step S105), and controls the output torques of the two motors 210 and 220 (Step S106). More specifically, the controller 110 reads the duty command value and the set current value corresponding to the current data number of the current event number in the control table 300. Then, the controller 110 controls the output torque of the stepping motor 210 by applying the read set current value only for the unit period. Similarly, the controller 110 controls the output torque of the DC brushless motor 220 by applying the read duty command value only for the unit period.

Next, the controller 110 detects the effective current value of the stepping motor 210 (step S107). More specifically, the controller 110 detects the current value actually supplied to the stepping motor 210 in the current unit period and detects the load on the stepping motor 210 (that is, the load applied to the conveyance roller 171). In a high rotation range, the effective current value of the stepping motor 210 increases as the load increases, and decreases as the load decreases. The effective current value of the stepping motor 210 is calculated, for example, as an RMS (Root Mean Square) value or an average value of a current waveform for one phase supplied to the stepping motor 210.

Next, the controller 110 determines whether the conveyance state of the sheet 500 has changed (step S108). In the present embodiment, for example, when the sheet 500 has reached the conveyance roller 171 to be controlled, the controller 110 determines that the conveyance state of the sheet 500 has changed. Alternatively, when the leading end of the sheet 500 has reached another conveyance roller adjacent to the conveyance roller 171 to be controlled on the downstream side while the sheet 500 passes through the conveyance roller 171 to be controlled, the controller 110 determines that the conveyance state of the sheet 500 has changed. Alternatively, when the trailing end of the sheet 500 passes through another conveyance roller 171 adjacent to the conveyance roller 171 to be controlled on the upstream side while the sheet 500 passes through the conveyance roller 171 to be controlled, the controller 110 determines that the conveyance state of the sheet 500 has changed. Alternatively, when the trailing end of the sheet 500 passes through the conveyance roller 171 to be controlled, the controller 110 determines that the conveyance state of the sheet 500 has changed. The change in the conveyance state is recognized by a change in ON/OFF of the photosensor 172 disposed on the conveying path of the sheet 500. When the conveyance state of the sheet 500 changes, the load applied to the conveyance roller 171 can also change.

When determining that the conveyance state of the sheet 500 has not changed (step S108: NO), the controller 110 increases the data number by "1" (step S109) and the process returns to the process of step S105. Then, the controller 110 repeats the process of step S105 and the subsequent steps until the conveyance state of the sheet 500 changes.

On the other hand, when determining that the conveyance state of the sheet 500 has changed (step S108: YES), the controller 110 resets the data number to "0" (step S110).

Next, the controller 110 compares the current values (step S111). More specifically, for example, the controller 110 compares the average value (moving average value) of the effective current value of the stepping motor 210 during the current event period with the average value of the predetermined reference current value. Details of the reference current value will be described later.

Next, the controller 110 determines whether the difference between the effective current value and the reference current value is within an allowable range (step S112). For example, the controller 110 determines whether the difference between the effective current value and the reference current value is within a range of ±10 mA.

When determining that the difference between the effective current value and the reference current value is within the allowable range (step S112: YES), the controller 110 proceeds to perform the process of step S115. On the other hand, when determining that the difference between the effective current value and the reference current value is not within the allowable range (step S112: NO), the controller 110 refers to a correction table 400 (see FIG. 7) (step S113), and changes the duty command value of the control table 300 (step S114).

FIG. 7 is a diagram showing an example of the correction table. The correction table 400 is a conversion table in which the difference between the effective current value and the reference current value of the stepping motor 210 and the change amount of the duty command value of the DC brushless motor 220 are mutually correlated. In the correction table 400, the change amount of the duty command value is defined so that the output torque of the DC brushless motor increases as the effective current value of the stepping motor 210 increases. The controller 110 calculates the change amount of the duty command value corresponding to the difference between the effective current value and the reference current value of the stepping motor 210 with reference to the correction table 400. Then, the controller 110 adds or subtracts the calculated change amount with respect to the duty command value corresponding to all of the data numbers of the current event in the control table 300, and rewrites the duty command value in the control table 300.

Next, the controller 110 determines whether one sheet 500 has passed through the conveyance roller 171 to be controlled (step S115). More specifically, the controller 110 determines whether the trailing end of the sheet 500 has passed through the conveyance roller 171 to be controlled from the output signal of the photosensor 172 provided in the vicinity of the conveyance roller 171 to be controlled.

When determining that the sheet 500 has not passed through the conveyance roller 171 to be controlled (step S115: NO), the controller 110 increases the event number by "1" (step S116) and the process returns to the process of step S105. Then, the controller 110 repeats the process of step S105 and the subsequent steps until the sheet 500 has passed through the conveyance roller 171 to be controlled. On the other hand, when determining that the sheet 500 has passed through the conveyance roller 171 to be controlled (step S115: YES), the controller 110 resets the event number to "0" (step S117).

Next, the controller 110 determines whether the print job has ended (step S118). More specifically, the controller 110 determines whether all sheets 500 have passed through the conveyance roller 171 to be controlled with respect to the print job in which images on a plurality of sheets 500 are continuously formed.

When determining that the print job has ended (step S118: YES), the controller 110 ends the process.

On the other hand, when determining that the print job has not ended (step S118: NO), the controller 110 returns to perform the process of step S104. Then, the controller 110 repeats the process of step S104 and the subsequent steps until the print job ends. At this time, when the duty command value of the control table 300 has been rewritten, the rewritten duty command value is applied and the output torque of the DC brushless motor 220 is controlled.

As described above, according to the process of the flowchart shown in FIGS. 4 and 5, the load applied to the conveyance roller 171 when the conveyance roller 171 to be controlled conveys the sheet 500 is detected. Then, the duty command value of the control table 300 is rewritten according to the load applied to the conveyance roller 171. More specifically, when the load applied to the conveyance roller 171 is heavy, the duty command value is rewritten so that the output torque of the DC brushless motor 220 increases. On the other hand, when the load applied to the conveyance roller 171 is light, the duty command value is rewritten so that the output torque of the DC brushless motor 220 decreases. According to such a configuration, when the conveyance roller 171 to be controlled conveys the next sheet 500, the load applied to the conveyance roller 171 is adjusted, and step-out of the stepping motor 210 is prevented. That is, with the drive mechanism that drives the rotating shaft 171*a* of the conveyance roller 171 by the two motors 210 and 220, it is possible to implement a stable operation against fluctuation of the load.

Next, with reference to FIGS. 8(*a*) to 8(*g*), the sheet conveyance process of the present embodiment will be described in more detail.

FIGS. 8(*a*) to 8(*g*) are diagrams for explaining the sheet conveyance process. FIG. 8(*a*) shows the output of the photosensor 172 provided in the vicinity of the another conveyance roller 171 adjacent to the conveyance roller 171 to be controlled on the upstream side. FIG. 8(*b*) shows the output of the photosensor 172 provided in the vicinity of the conveyance roller 171 to be controlled. FIG. 8(*c*) shows the output of the photosensor 172 provided in the vicinity of still another conveyance roller 171 adjacent to the conveyance roller 171 to be controlled on the downstream side.

When the sheet 500 is conveyed in the conveying path inside the image forming apparatus 100, the sheet 500 first reaches the conveyance roller 171 on the upstream side, and then sequentially reaches the conveyance roller 171 to be controlled and the conveyance roller 171 on the downstream side. Therefore, first, as shown in FIG. 8(*a*), the photosensor 172 in the vicinity of the conveyance roller 171 on the upstream side is turned ON, and next, as shown in FIG. 8(*b*), the photosensor 172 in the vicinity of the conveyance roller 171 to be controlled is turned ON. Then, as shown in FIG. 8(*c*), the photosensor 172 in the vicinity of the conveyance roller 171 on the downstream side is turned ON. Thereafter, as the conveyance of the sheet 500 proceeds, the photosensor 172 of the conveyance roller 171 on the upstream side, the photosensor 172 of the conveyance roller 171 to be controlled, and the photosensor 172 of the conveyance roller 171 on the downstream side returns to the OFF state from the ON state in this order.

FIG. 8(*d*) shows an example of the reference value of the current actually supplied to the stepping motor 210 during the conveyance period of the sheet 500, and FIG. 8(*e*) shows an example of the duty command value of the DC brushless motor 220 during the conveyance period of the sheet 500.

In the sheet conveyance process of the present embodiment, while the conveyance roller 171 conveys the sheet 500, the operation of the stepping motor 210 is controlled by applying the set current value described in the control table 300. At this time, as shown in FIG. 8(*d*), the ideal value of the current value (effective current value) of the current actually supplied to the stepping motor 210 is obtained in advance as the reference current value. In the sheet conveyance process of the present embodiment, as shown in FIG. 8(*e*), while the conveyance roller 171 conveys the sheet 500, the operation of the DC brushless motor 220 is controlled by applying the duty command value described in the control table 300. In the ideal state, the operation of the DC brushless motor 220 is controlled so that the power of the DC brushless motor assists the rotation of the stepping motor 210.

FIG. 8(*f*) shows an example of the effective current value of the stepping motor 210, and FIG. 8(*g*) shows an example of the duty command value of the DC brushless motor 220 when the next sheet 500 is conveyed.

As described above, the effective current value of the stepping motor 210 changes in accordance with the load applied to the conveyance roller 171. In FIG. 8(*f*), during the first period T1 from when the photosensor in FIG. 8(*b*) is turned ON to when the photosensor in FIG. 8(*a*) is turned OFF, the effective current value of the stepping motor 210 is larger than the reference current value. On the other hand, during the second period T2 from when the photosensor in FIG. 8(*a*) is turned OFF to when the photosensor in FIG. 8(*b*) is turned OFF, the effective current value of the stepping motor 210 is smaller than the reference current value. That is, during the first period T1, the load applied to the conveyance roller 171 is heavy, and the load applied to the conveyance roller 171 during the second period T2 is light. These loads are caused by a difference in sheet conveyance speed of the plurality of pairs of conveyance rollers 171 that hold the sheet 500.

In the sheet conveyance process of the present embodiment, in such a case, as shown in FIG. 8(*g*), when the conveyance roller 171 to be controlled conveys the next sheet 500, the control table 300 is rewritten so that the duty command value of the DC brushless motor 220 increases during the first period T1. On the other hand, during the second period T2, the control table 300 is rewritten so that the duty command value of the DC brushless motor 220 decreases. As a result, when the conveyance roller 171 to be controlled conveys the next sheet 500, the output torque of the DC brushless motor 220 is increased during the first period T1 and the output torque of the DC brushless motor 220 is reduced during the second period T2.

As described above, according to the sheet conveyance process of the present embodiment, the load applied to the conveyance roller 171 to be controlled is detected during the conveyance period of one sheet 500, and in accordance with the load, the output torque of the DC brushless motor 220 during the conveyance period of the next sheet 500 is changed. More specifically, when the load applied to the conveyance roller 171 is heavy, the output torque of the DC brushless motor 220 is increased, and when the load applied to the conveyance roller 171 is light, the output torque of the DC brushless motor 220 is reduced. According to such a configuration, when the next sheet 500 is conveyed, the load applied to the conveyance roller 171 is adjusted, and step-out of the stepping motor 210 is prevented. When the output torque of the DC brushless motor 220 is adjusted, the assist control in which the power of the DC brushless motor 220 assists the rotation of the stepping motor 210, the brake control in which the power of the DC brushless motor 220 prevents the rotation of the stepping motor 210, or the neutral control in which the power of the DC brushless motor 220 does not affect the rotation of the stepping motor 210 are performed.

(Modification)

In the above-described embodiment, when the load applied to the conveyance roller 171 is light, the control table 300 is rewritten and the output torque of the DC brushless motor 220 is reduced. However, when the load applied to the conveyance roller 171 is light, the output torque of the stepping motor 210 in addition to the output torque of the DC brushless motor 220 may be reduced.

FIGS. 9(*a*) to 9(*c*) are diagrams for explaining a sheet conveyance process according to a modification. FIG. 9(*a*) shows an example of the effective current value of the stepping motor 210, and FIG. 9(*b*) shows an example of the duty command value of the DC brushless motor 220 when the next sheet 500 is conveyed. FIG. 9(*c*) shows an example of the set current value of the stepping motor 210 when the next sheet is conveyed.

In FIG. 9(*a*), the load applied to the conveyance roller 171 is reduced during the conveyance period of the sheet 500. In the sheet conveyance process according to the modification, in such a case, the control table 300 is rewritten so that, as shown in FIGS. 9(*b*) and 9(*c*), the duty command value of the DC brushless motor 220 is reduced, and the set current value of the stepping motor 210 is reduced. According to such a configuration, power consumption can be suppressed.

Second Embodiment

Next, a second embodiment of the present invention will be described with reference to FIGS. 10 and 11. The present embodiment is an embodiment in which the control table 300 is changed temporarily or permanently.

The storage 120 of the image forming apparatus 100 according to the present embodiment stores an initial table and a history table (not shown) in addition to the control table 300 and the correction table 400. A plurality of control tables 300 and a plurality of initial tables are stored for each sheet type. The initial table is similar to the control table 300, and for example, when the image forming apparatus 100 is powered on, the initial table is used as the control table 300. Since the configuration of the image forming apparatus 100 according to the present embodiment is the same as that of the first embodiment, the detailed description of the image forming apparatus 100 will be omitted.

Figure 10:
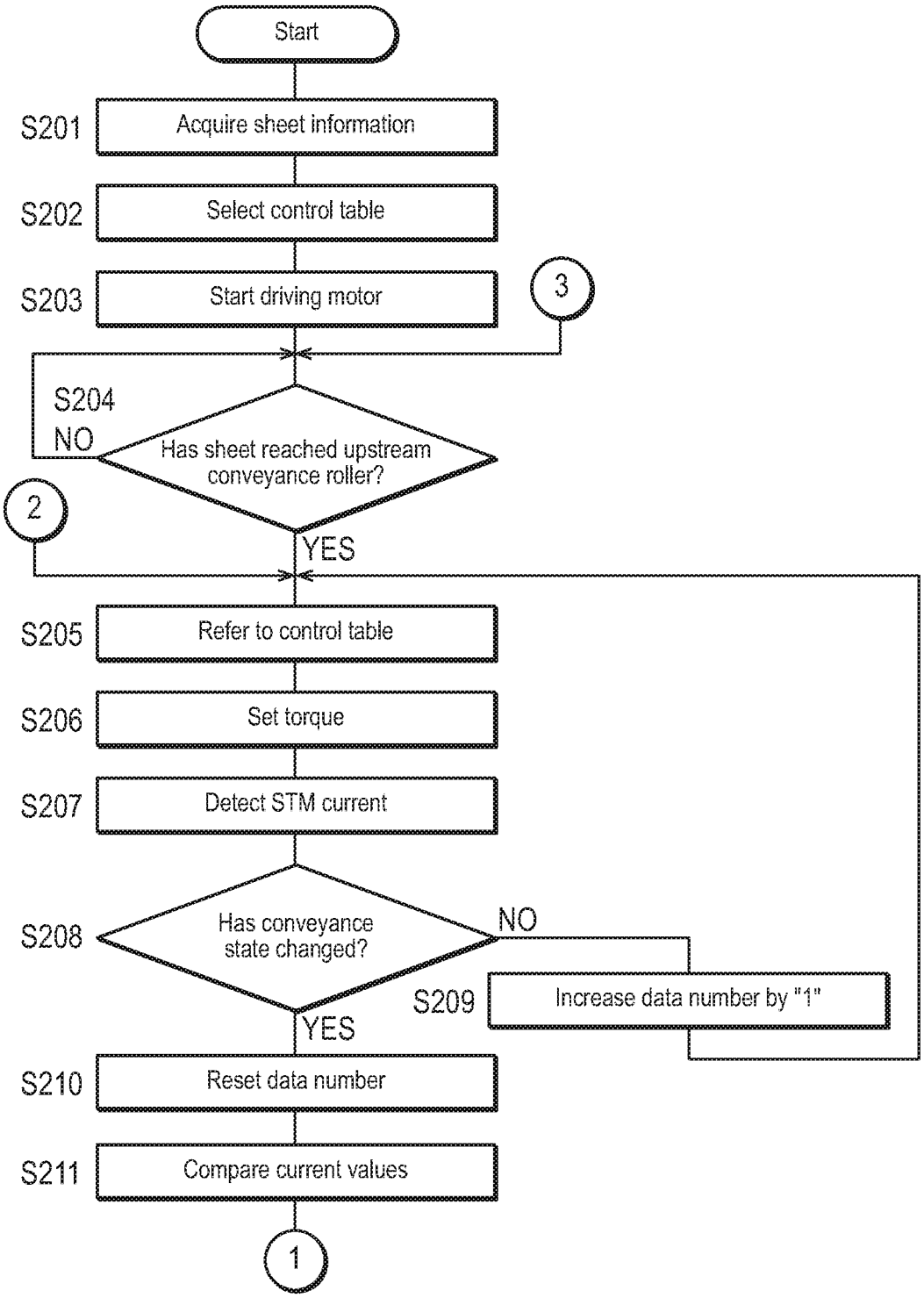
FIG. 10 is a flowchart showing a procedure of the sheet conveyance process according to a second embodiment of the present invention.
Figure 11:
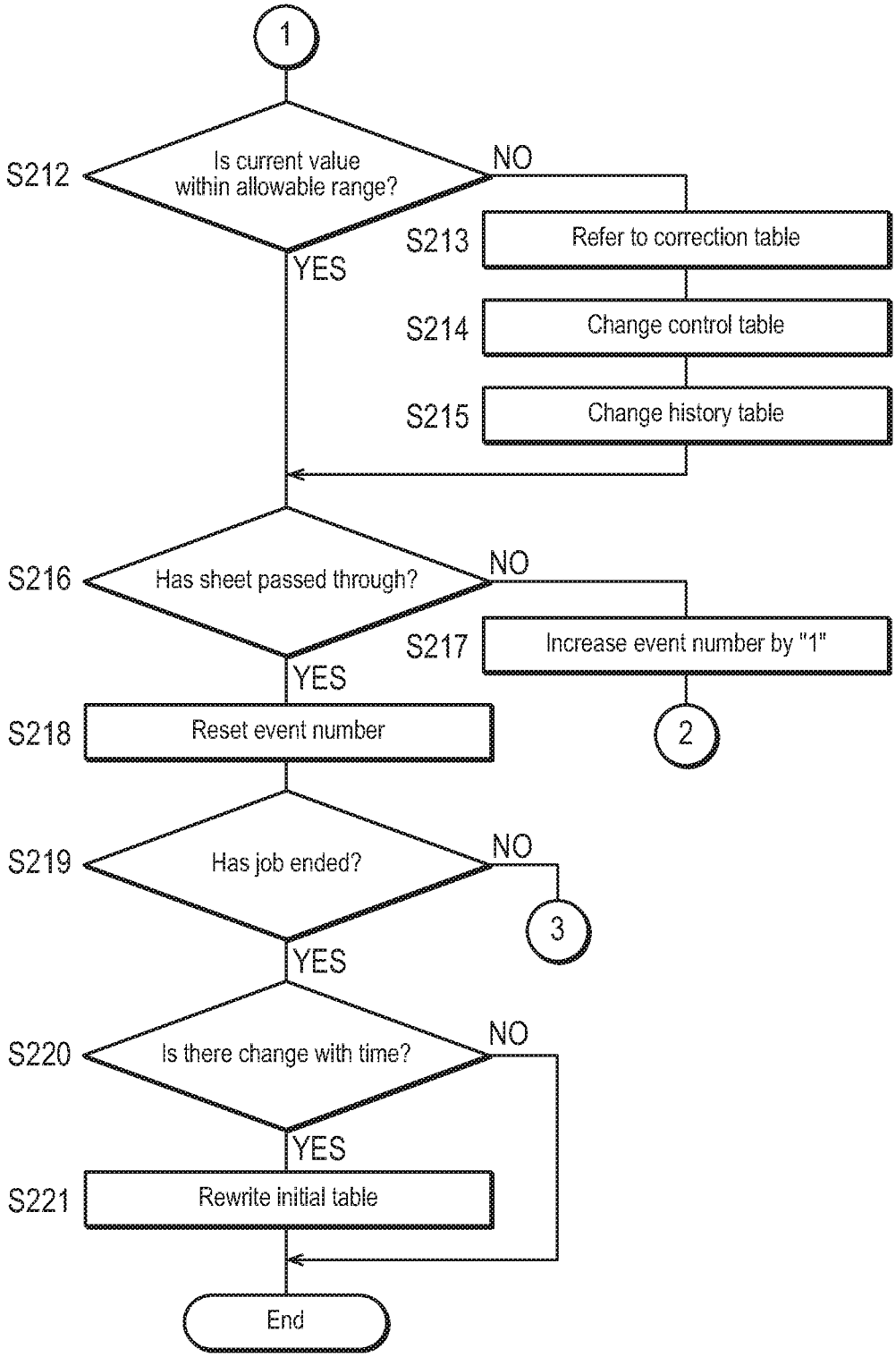
FIG. 11 is a flowchart following FIG. 10.

FIGS. 10 and 11 are a flowchart showing a procedure of the sheet conveyance process according to the present embodiment.

First, the controller 110 acquires information on the sheet used for printing and recognizes the type of the sheet 500 (step S201).

Next, the controller 110 selects one control table 300 corresponding to the type of sheet among the plurality of control tables 300 stored in the storage 120 for each type of sheet (step S202). In the present embodiment, for example, in a case where the print job executed by the image forming apparatus 100 is the first print job after the image forming apparatus 100 is turned ON, the initial table is used as the control table 300. On the other hand, in a case where the print job executed by the image forming apparatus 100 is the second or subsequent print job after the image forming apparatus 100 is turned ON, the control table 300 stored in the storage 120 is used as it is as a control table.

Since the processes of steps S203 to S212 is similar to the processes of steps S103 to S112 in FIG. 4, description thereof is omitted.

When it is determined in the process shown in step S212 that the difference between the effective current value and the reference current value is within the allowable range (step S212: YES), the controller 110 proceeds to perform the process of step S216.

On the other hand, when determining that the difference between the effective current value and the reference current value is not within the allowable range (step S212: NO), the controller 110 refers to the correction table 400 (step S213), and changes the duty command value of the control table 300 (step S214).

Next, the controller 110 changes the history table (step S215). In the present embodiment, the controller 110 describes the effective current value of the stepping motor 210 in the history table stored in the storage 120. The effective current value is used as a parameter that reflects a change with time of the conveyance roller 171. In the history table, for example, data of the effective current value for one month is described in order to detect the change with time of the conveyance roller.

Since the processes of steps S216 to S219 is similar to the processes of steps S115 to S118 in FIG. 5, the description will be omitted.

In the process shown in step S219, when determining that the print job has not ended (step S219: NO), the controller 110 returns to perform the process of step S204.

On the other hand, when determining that the print job has ended (step S219: YES), the controller 110 determines whether there is the change with time (step S220). More specifically, when the long-term change amount of the effective current value described in the history table (for example, the average value of the change amount for one month) is larger than the predetermined value, the controller 110 determines that there is the change with time.

When determining that there is no change with time (step S220: NO), the controller 110 ends the process. On the other hand, when determining that there is the change with time (step S220: YES), the controller 110 rewrites the initial table (step S221) and ends the process. More specifically, the controller 110 replaces the initial table with the control table 300, and ends the process. As a result, for example, when the image forming apparatus 100 is activated and the print job is performed the next day, the sheet conveyance process is performed using the initial table replaced with the control table 300.

As described above, according to the process of the flowcharts shown in FIGS. 10 and 11, the load applied to the conveyance roller 171 is detected when the sheet 500 is conveyed, and the output torque of the DC brushless motor 220 at the time of conveying the next sheet 500 is changed. When the print job is completed, in a case where the value of the parameter reflecting the change with time exceeds the predetermined value, the initial table is replaced with the control table 300 and the contents of the control table 300 is used on the next day and subsequent days. That is, the control table 300 is permanently rewritten.

On the other hand, in a case where the value of the parameter reflecting the change with time is equal to or less than the predetermined value, the initial table is not replaced with the control table 300, and the initial table is used as the control table on the next day. That is, the control table 300 is temporarily rewritten, and the current control table 300 is not used from the following day.

As described above, according to the sheet conveyance process of the present embodiment, the control table 300 is permanently rewritten when there is a change with time, and the control table 300 is temporarily rewritten when there is no change with time.

In the above-described embodiment, it is determined whether the control table 300 is temporarily rewritten or permanently rewritten based on the parameter reflecting the change with time. However, unlike the present embodiment, it may be determined whether the control table 300 is temporarily rewritten or permanently rewritten based on the temperature/humidity inside or around the image forming apparatus 100. In this case, for example, when the temperature/humidity of the image forming apparatus 100 is higher than a predetermined value, the control table 300 is temporarily rewritten without replacing the initial table with the control table 300. Thereafter, when the situation where the temperature/humidity of the image forming apparatus 100 is higher than the predetermined value is removed, the control table 300 is discarded and the initial table is used as a new control table.

The present invention is not limited to only the first and second embodiments described above, and various modifications can be made within the scope of the claims.

For example, in the above-described first and second embodiments, the plurality of control tables 300 are prepared according to the type of sheet. However, the plurality of control tables 300 may be prepared according to the temperature/humidity of the image forming apparatus 100. In this case, the temperature/humidity information of the image forming apparatus 100 is acquired, and the control table 300 is selected according to the temperature/humidity. Further, the plurality of control tables 300 may be prepared according to combination of the types of sheet and temperature/humidity.

In the first and second embodiments described above, when the effective current value of the stepping motor 210 is not within the predetermined allowable range, the duty command value of the control table 300 is changed with reference to the correction table 400. However, without determining whether the current value of the stepping motor 210 is within the allowable range, the correction table 400 may be referred, and the duty command value of the control table 300 may be changed.

Further, in the above-described embodiments, the average value of the effective current value and the average value of the reference current value are compared with each other in one event unit, and the duty command value of the control table 300 is changed according to the comparison result. However, the effective current value and the reference current value may be compared in one or a plurality of data units within one event, and the duty command value of the control table 300 may be changed according to the comparison result.

In addition, in the first and second embodiments described above, the load applied to the conveyance roller 171 is detected by detecting the effective current value of the stepping motor 210. However, it is also possible to calculate the speed difference in the sheet conveyance speeds of respective conveyance rollers from the detection timing of the plurality of photosensors 172 on the sheet conveying path, and predict the load on the conveyance roller 171.

Further, in the first and second embodiments described above, the case where the activated conveyance roller 171 conveys the sheet 500 has been described as an example. However, the drive apparatus 200 of the present invention is also applied to the synchronous control in which the conveyance roller to be controlled and another conveyance roller adjacent to the conveyance roller to be controlled are simultaneously activated to convey the sheet 500.

Further, in the first and second embodiments described above, the case where the drive apparatus 200 of the present invention is applied to the image forming apparatus 100 has been described as an example. However, the drive apparatus 200 of the present invention may be applied to a post-processing apparatus connected to the image forming apparatus, and may drive the rotating shaft of the conveyance roller inside the post-processing apparatus.

In addition, in the first and second embodiments described above, the case where the drive apparatus 200 of the present invention includes the stepping motor 210 and the DC brushless motor 220 has been described as an example. However, the motor included in the drive apparatus 200 is not limited to the stepping motor and the DC brushless motor, but may be two DC brushless motors.

The means and method for performing various processes in the image forming apparatus 100 according to the first embodiment and the second embodiments can be implemented by either a dedicated hardware circuit or a programmed computer. The program may be provided through a computer-readable recording medium such as a CD-ROM (Compact Disc Read Only Memory), or may be provided online via a network such as the Internet. In this case, the program recorded on the computer readable recording medium is usually transferred to and stored in a storage such as a hard disk. Further, the above program may be provided as standalone application software or may be incorporated in software of the image forming apparatus as one function thereof.

Although embodiments of the present invention have been described and illustrated in detail, the disclosed embodiments are made for purpose of illustration and example only and not limitation. The scope of the present invention should be interpreted by terms of the appended claims.

What is claimed is:

1. A drive apparatus comprising:

a first motor that transmits a power to a rotating shaft of a conveyance roller for conveying a sheet;

a second motor that transmits a power to said rotating shaft of said conveyance roller;

a storage that stores information indicating a driving force of said second motor during a period in which said conveyance roller conveys said sheet; and a controller that drives said second motor with said driving force indicated by said information during a period when said conveyance roller conveys said sheet, wherein said controller changes said information stored in said storage according to a load applied to said conveyance roller during said period when said conveyance roller conveys said sheet, and drives said second motor with a driving force indicated by said changed information after said change during a period when said conveyance roller conveys a next sheet.

2. The drive apparatus according to claim 1, wherein said controller changes said information so that said driving force of said second motor increases as said load applied to said conveyance roller increases.

3. The drive apparatus according to claim 1, wherein said first motor is a stepping motor, and said second motor is a brushless motor.

4. The drive apparatus according to claim 1, wherein said storage stores at least one control table in which said information is described, and wherein said controller rewrites said information in said at least one control table.

5. The drive apparatus according to claim 4, wherein said at least one control table includes a plurality of control tables, and said plurality of control tables is generated according to a type of sheet.

6. The drive apparatus according to claim 1, wherein said changed information is temporarily or permanently stored in said storage.

7. The drive apparatus according to claim 6, wherein when a value of a parameter reflecting a change with time is larger than a predetermined value, said changed information is permanently held.

8. The drive apparatus according to claim 6, wherein when at least one of a temperature and a humidity is higher than a predetermined value, said changed information is temporarily held.

9. The drive apparatus according to claim 1, wherein said second motor is a brushless motor, and wherein said controller controls said driving force of said second motor by setting a duty command value of said second motor.

10. The drive apparatus according to claim 1, wherein by controlling said driving force of said second motor, assist control in which said power of said second motor assists a rotation of said first motor is performed, or brake control in which said power of said second motor prevents the rotation of said first motor is performed.

11. The drive apparatus according to claim 1, wherein said controller performs synchronous control for simultaneously activating said conveyance roller to be controlled and another conveyance roller adjacent to said conveyance roller to be controlled along a conveyance direction of said sheet.

12. The drive apparatus according to claim 1, wherein said controller changes said information in period unit obtained by a division at a predetermined timing, and wherein said predetermined timing includes a timing at which a trailing end of said sheet has passed through another conveyance roller adjacent to said conveyance roller to be controlled on an upstream side in said conveyance direction of said sheet, or a timing at which a leading end of said sheet reaches another conveyance roller adjacent to said conveyance roller to be controlled on a downstream side in said conveyance direction.

13. The drive apparatus according to claim 1, wherein said storage further stores information indicating a driving force of said first motor, and wherein when said load is smaller than a predetermined value, said controller changes said information indicating said driving force of said first motor so that said driving force of said first motor is small.

14. An image forming apparatus comprising the drive apparatus according to claim 1.

* * * * *